United States Patent [19]

de Nora

[11] 4,343,690

[45] Aug. 10, 1982

[54] NOVEL ELECTROLYSIS CELL

[75] Inventor: Oronzio de Nora, Milan, Italy

[73] Assignee: Oronzio de Nora Impianti Elettrochimici S.p.A., Milan, Italy

[21] Appl. No.: 102,629

[22] Filed: Dec. 11, 1979

[30] Foreign Application Priority Data

Aug. 3, 1979 [IT] Italy ..... 24919 A/79

[51] Int. Cl.[3] ..... C25B 9/00

[52] U.S. Cl. ..... 204/263; 204/266; 204/282; 204/283

[58] Field of Search ..... 204/282–283, 204/267, 269–270, 263–266, 253–256, 98, 128

[56] References Cited

U.S. PATENT DOCUMENTS

| | | | |
|---|---|---|---|
| 3,379,634 | 4/1968 | Rutkowski | 204/129 |
| 3,446,725 | 5/1969 | Spengler et al. | 204/129 |
| 3,475,302 | 10/1969 | Langer et al. | 204/129 |
| 4,024,036 | 5/1977 | Nakamura et al. | 204/129 |
| 4,056,452 | 11/1977 | Campbell | 204/258 |
| 4,057,479 | 11/1977 | Campbell | 204/258 |
| 4,191,618 | 3/1980 | Coker et al. | 204/98 |
| 4,253,922 | 3/1981 | Welch | 204/98 |

FOREIGN PATENT DOCUMENTS

| | | | |
|---|---|---|---|
| 1268182 | 3/1972 | United Kingdom | 204/282 |
| 1490650 | 11/1977 | United Kingdom | 204/282 |

*Primary Examiner*—R. L. Andrews

*Attorney, Agent, or Firm*—Hammond & Littell, Weissenberger and Muserlian

[57] ABSTRACT

A cell is provided having an anode and cathode separated by an ion permeable membrane or diaphragm wherein an electrode layer is bonded to or otherwise embedded in on at least one and usually to both sides of the membrane. Polarity is imparted to a bonded or embedded electrode by pressing a crinkled resiliently compressible fabric against the membrane carrying the electrode layer. This fabric is substantially coextensive with the electrode layer and is constructed so that when compressed it exerts a substantially uniform elastic reaction pressure against the membrane carrying the electrode layer or a pliable foraminous sheet, i.e. screen, interposed between the membrane carrying the electrode layer and the resiliently compressible fabric. The resiliently compressible fabric has the ability of also transmitting pressure laterally so that pressure applied may distribute across the entire area of the layer and tendency to have local areas of too low or too high pressure is minimized or reduced.

Chlorine or other halogen is produced by feeding an aqueous alkali metal halide or aqueous hydrogen halide to the anode chamber. Alkali is produced in the cathode chamber and withdrawn.

47 Claims, 8 Drawing Figures

NOVEL ELECTROLYSIS CELL

BACKGROUND OF INVENTION

This invention relates to a novel method of generating chlorine or other halogen by electrolysis of an aqueous halide such as hydrochloric and/or alkali metal chloride or other corresponding electrolysable halide.

It has been proposed to conduct such electrolysis between an anode and cathode separated by a diaphragm notably an ion exchange membrane wherein the anode, cathode or both are in the form of a thin porous layer of electroconductive material resistant to electrodic attack and bonded or otherwise incorporated over the surface of the diaphragm. Similar electrode-membrane assemblies have been proposed for a long time for use in fuel cell. Such cells have been called "solid polymer electrolyte" cells.

Such cells have been used for a long time as gaseous-fuel cells, and only recently have been successfully tested for the electrolytic production of chlorine from hydrochloric acid or alkali metal chloride brines.

In a solid polymer electrolyte cell for the production of chlorine, the electrodes usually consist of a thin porous 1*a* yer of electroconductive catalytic material permanently bonded on the surface of an ion-exchange membrane by means of a binder usually composed of a fluorinated polymer such as, for example, polytetrafluoroethylene (PTFE).

According to one of the preferred procedures of forming the gas permeable electrodes, as described in U.S. Pat. No. 3,297,484 to Niedrach, powder of electroconductive and catalytic material is blended with an aqueous dispersion of PTFE particles obtaining a doughy mixture containing 2 to 20 grams of powder per gram pf PTFE.

The mixture, which may be diluted if desired, is spread onto a supporting metal sheet and dried. The powder layer is then covered with aluminum foil and pressed at a temperature sufficient to effect the sintering of the PTFE particles, obtaining a thin coherent film.

After removal of the aluminum foil by caustic leaching, the preformed electrode is applied onto the surface of the membrane and pressed at a temperature sufficient to cause the PTFE matrix to sinter onto the membrane.

After rapid quenching, the supporting metal sheet is removed and the electrode remains bonded on the membrane.

As the electrodes of the cell are intimately bonded on the opposite surfaces of the membrane separating the anode and the cathode chambers, and are not therefore separately supported by metal structures, it has been discovered that the most efficient way to carry and distribute the current to the electrodes consists in resorting to multiple contacts uniformly distributed all over the electrode surface by means of current-carrying structures provided with a series of projections or ribs which, during the assembly of the cell, contact the electrode surface on a multiplicity of evenly distributed points. The membrane, carrying on its opposite surfaces the bonded electrodes, must then be pressed between the two current-carrying structures or collectors, respectively anodic and cathodic.

Contrary to what happens in fuel cells, wherein the reactants are gaseous, the current densities small and wherein practically no electrodic side-reaction can occur, in the solid electrolyte cells for electrolysis of solutions, as in the particular instance of sodium chloride brines, give rise to problems of difficult resolution.

In a cell for the electrolysis of sodium chloride brine, the following reactions take place at the various part of the cell:

main anodic reaction: $2\ Cl^- \rightarrow Cl_2 + 2e^-$ transport across the membrane: $2\ Na^+ + H_2O$ cathode reaction: $2\ H_2O + 2e^- \rightarrow 2OH^- + H_2$ anodic side-reaction: $4\ OH^- \rightarrow O_2 + 2H_2O + 4e^-$ main overall reaction: $2\ NaCl + 2H_2O \rightarrow 2\text{-}NaOH + Cl_2 + H_2$ Therefore at the anode, besides the desired main reaction of chlorine discharge, a certain water oxidation also occurs, although to an extent held as low as possible, with consequent oxygen evolution. This trend to oxygen evolution is practically enhanced by an alkaline environment at the active sites of the anode, consisting of the catalyst particles contacting the membrane.

In fact, the cation-exchange membranes suitable for the electrolysis of alkali metal halides have a transfer number different from the unit and, in conditions of high alkalinity in the catholyte some of these members allow some migration of hydroxyl anions from the catholyte to the anolyte across the membrane.

Moreover, the conditions necessary for an efficient transfer of liquid electrolytes to the active surfaces of the electrodes and for gas evolution thereat require anode and cathode chambers characterized by flow sections for the electrolytes and gases relatively much larger than those adopted in fuel cells.

The electrodes must conversely have a minimum thickness, usually in the range of 40–150 μm, to allow an efficient mass exchange with the bulk of the liquid electrolyte. Because of this requirement, together with the fact that the electrocatalytic and conductive materials constituting the electrodes, particularly the anode, is frequently a mixed oxide comprising a platinum group metal oxide or a pulverulent metal bonded by a binder having low or nil electroconductivity, the electrodes are barely conductive, in the direction of their major dimension.

Therefore a high density of contacts with the collector is required as well as a uniform contact pressure to limit the ohmic drop through the cell and to afford a uniform current density all over the active surface of the cell.

These requirements have been so far extremely hard to fulfil, especially in cells characterized by large surfaces as the ones industrially employed in the plants for the production of chlorine with capacities generally greater than one hundred tons of chlorine a day.

Industrial cells require, for economic reasons, electrodic surfaces in the range of at least 0.5 preferably 1 to 3 square meters or above and are often electrically connected in series to form electrolyzers comprising up to several tens of biopolar cells assembled by means of tie rods or hydraulic or pneumatic jacks in a filter-press-type arrangement.

Cells of this size pose great technological problems as regards producing current carrying structures, that is current collectors, with extremely low tolerances for the planarity of the contacts and such as to provide a uniform contact pressure all over the electrode surface after the assembling of the cell. Moreover, the membrane used in such cells must be very thin to limit the ohmic drop across the solid electrolyte in the cell. This thickness is often lower than 0.2 mm. and rarely more than 2 millimeters and the membrane may be easily ruptured or unduly thinned out in the points whereto an excessive pressure is applied during the closing of the cell.

Therefore, both the anodic and the cathodic collector, besides being almost perfectly planar, must also be almost exactly parallel.

In cells of small size, a high drgree of planarity and parallelism can be maintained, meanwhile providing a certain flexibility of the collectors to make up for the slight deviations from an exact planarity and parallelism.

In commonly assigned copending United States Application Serial No. 57,255 filed on July 12, 1979, there is disclosed a solid electrolyte monopolar-type cell for the electrolysis of sodium chlorine, wherein both the anodic and the cathodic current collector consist of screens or expanded sheets welded onto respective series of vertical metal ribs, which are offset one another, thus permitting a certain bending of the screens during the assembly of the cell in order to exert a more uniform pressure on the membrane surfaces.

In commonly assigned copending U.S. patent application Ser. No. 951,984 filed on Oct. 16, 1978, now abandoned in favor of cip application Ser. No. 50,143 filed June 19, 1979, now U.S. Pat. No. 4,240,888, a solid electrolyte bipolar-type cell is described for the electrolysis of sodium chloride wherein the bipolar separators are provided on both sides thereof and in the area corresponding to the electrodes, with a series of ribs or projections.

To make up for slight deviations from planarity and parallelism, the insertion is contemplated of a resilient means consisting of two or more valve metal screens or expanded sheets coated with a non-passivatable material, said resilient means being compressed between the anode-side ribs and the anode bonded to the anodic side of the membrane.

It has been observed however, that both solutions, as proposed in the two cited Patent Applications, entail serious limitations and disadvantages in cells characterized by large electrodic surfaces.

In the first instance, the desired uniformity of contact pressure tends to be lacking, thus giving rise to current concentrations in points of greater contact pressure with consequent polarization phenomena and the related deactivation of the membrane and of the catalytic electrodes; localized ruptures of the membrane and localized mechanical losses of catalytic material often occur during the assembly of the cell.

In the second instance, a very high planarity and parallelism of the bipolar separator surfaces must be provided for; this however requires precise and costly machining of the ribs and the seal surface of the bipolar separator. Moreover, the high rigidity of the elements entail pressure concentrations which tend to accumulate along the series, thus limiting the number of assemblable elements in a single filter-press arrangement.

As a result of these difficulties a current distributor screen when pressed against the electrode may even leave some electrode areas untouched or contacted so lightly that they are essentially ineffective.

Comparable tests which have been made by pressing distributor screen against pressure sensitive paper capable of showing a visible impression corresponding to the screen have shown that substantial areas ranging above 10 percent to as high as 30 to 40 percent of the screen area produce no marking on the paper. This indicates that such unduly large areas remain untouched.

Applying this observation to the electrodes it appears that substantial electrode surface areas can be inoperative or substantially so.

THE INVENTION

According to this invention it has been found that effective electrical contact with the electrode on the membrane or diaphragm may be achieved and polarity imparted thereto readily and without inducing an excessive pressure in local areas by pressing the current distributing or electrically charging surface against the electrode by means of a readily compressible resilient sheet or layer or mat which extends along a major part and usually substantially all of the surface of the electrode layer bonded to the membrane.

This compressible layer is springlike in character and, while capable of being compressed to a reduction of up to 60% or more of its uncompressed thickness against the membrane carrying the electrode layer by application of pressure from a backwall or pressure member, it is also capable of springing back substantially to its initial thickness upon release of the clamping pressure. Thus, by its elastic memory, it applies substantially uniform pressure against the membranes carrying the electrode layer since it is capable of distributing pressure stress and of compensating for irregularities in the surfaces with which it is in contact. The compressible sheet also should provide ready access of the electrolyte to the electrode and ready escape of the electrode products whether gas or liquid from the electrode.

Thus it is open in structure and encloses a large free volume. The resilient compressible sheet is eventually conductive generally being of a metal resistant to the electrochemical attack of the electrolyte in contact therewith and thus distributes polarity and current over the entire electrode layer. It may engage the electrode layers directly.

Alternatively and preferably this conductive resilient compressible sheet may have a pliable electroconductive screen of nickel, titanium, niobium or other resistant metal between the sheet or mat and the electrode layer.

This screen is a thin foraminous sheet which readily flexes and accomodates for surface irregularities in the electrode surface. It mahy be a screen of fine net work or a perforated film. Usually it is of finer mesh than the compressible layer and less compressible or substantially non-compressible.

It is therefore a principal object of this invention to provide a cell having an electrode bonded to or incorporated in an ion permeable membrane and having a new and improved current collector or distributor which can be easily compressed and has high resiliency and is capable of effectively distributing a clamping pressure of the cell in a substantially uniform manner over the entire electrode surface.

These and other objects and advantages of the invention will become apparent from the ensuing description of the invention and some preferred embodiments thereof.

A preferred embodiment of the resilient current collector of the present invention suitable for use in solid electrolyte cells is characterized in that it consists of a substantially open mesh planar electroconductive metal-wire article or screen i.e. fabric resistant to the electrolyte and the electrolysis products, and in that some or all of the wires form a series of coils, waves or crimps or other undulating contour whose diameter or amplitude are substantially in excess of the wire thickness and preferably correspond to the article thickness, along at least one directrix parallel to the plane of the article.

Of course such crimps or wrinkles are disposed in the direction across the thickness of the screen.

These wrinkles in the form of crimps, coils, waves or the like have side portions which are sloped or curved with respect to the axis normal to the thickness of the wrinkled fabric so that, when the collector is compressed, some displacement and pressure is transmitted laterally so as to make distribution of pressure more uniform over the electrode area. That is, some coils or wire loops which, because of irregularities on the planarity or parallelism of the surfaces compressing the fabric, may be subjected to a compressive force greater than that acting on adjacent areas are capable of yielding more and to discharge the excess force by transmitting it to neighboring coils or wire loops.

Therefore the fabric is effective in acting as a pressure equalizer to a substantial extent and in preventing that the elastic reaction force acting on a single contact point exceeds the limit whereby the membrane is excessively pinched or pierced.

Of course such self adjusting capabilities of the resilient collector is instrumental in obtaining a good and uniform contacts distribution over the entire surface of the electrode.

One very effective embodiment desirably consists of a series of helicoidal cylindrical spirals of wire whose coils are mutually wound with the ones of the adjacent spiral in an intermeshed or interlooped relationship.

The spirals are of a length substantially corresponding to the height or width of the electrodic chamber or at least 10 or more centimeters in length and the number of intermeshed spirals is sufficient to span the whole width thereof. According to this preferred arrangement, the wire helix itself represents a very small portion of the section of the electrodic chamber enclosed by the helix and therefore the helix is open on all sides thus allowing the circulation of the electrolyte and the rise of the gas bubbles along the chamber.

It is not however necessary for the helicoidal cylindrical spirals to be wound in an intermeshed relationship with the adjacent spirals as previous described, and they may also consist of single adjacent metal wire spirals. In this case, the spirals are juxtaposed one beside another, the respective coils being merely engaged in an alternate sequence.

By this way, a higher contact density may be achieved with the co-operating planes represented by the counter electrode or counter current collector and the cell end-plate. According to a further embodiment, the current collector consists of a crimped knitted mesh or fabric of metal wire so that every single wire forms a series of waves of an amplitude corresponding to the maximum height of the crimping of the knitted mesh or fabric; every metal wire thus contacts in an alternate sequence the cell end-plate (which serves as the plate to apply the pressure) and the electrode bonded on the membrane surface or the intermediate flexible screen interposed between the electrode and the compressible layer.

As an alternative, two or more knitted meshes or fabrics, after being individually crimped by forming, may be superimposed one upon another to obtain a collector of the desired thickness.

The crimping of the metal mesh or fabric imparts to the collector a great compressibility and an outstanding resiliency to compression under a load which may be about 80–600 grams per square centimeter ($g/cm^2$) of surface applying the load, i.e. the back-or end-plate.

The collector of the invention, after the assemblying of the cell, has a thickness preferably corresponding to the depth of the electrodic chamber. However the depth of the chamber may conveniently be made larger. In this instance a foraminous and substantially rigid screen or a plate spaced from the surface of the backwall of the chamber may act as the compressing surface against the compressible resilient collector mat. The collector is capable of being compressed to a much lower thickness and volume. For example it may be compressed to about 50 to 90 percent or even lesser percent of its initial volume and/or thickness. It is therefore pressed or compressed between the membrane-bonded electrode and the conducting end-plate of the cell by clamping these members together. The current collector is not welded or bonded to the cell end-plate or interposed screen and transmits the current essentially by mechanical contact with the same, suitably connected to the electrical source, and with the electrode.

Thus the collector is moveable with respect to the surface of these elements. When clamping pressure is applied the wire loops or coils constituting the resilient mat may deflect and slide laterally and distribute pressure uniformly over the entire surfaces with which it contacts. In this way it functions in a manner superior to individual springs distributed over an electrode surface since the springs are fixed and there is not interaction between pressure points to compensate for surface irregularities of the bearing surfaces.

A large portion of the clamping pressure of the cell is elastically memorized by every single coil or wave of the metal wires forming the current collector. As practically no severe mechanical strains are created by the differential elastic deformation of one or more single coils or crimps of the article, with respect to the adjacent ones, the resilient collector of the invention can effectively prevent or avoid the piercing of the membrane at the more strained points or areas during the assembly of the cells. Rather high deviations from the planarity of the current-carrying structure of the opposed electrode can be thus tolerated, as well as deviations from the parallelism between said structure and the side of the resilient collector of the cell end-plate.

The resilient current collector of the invention is advantageously the cathodic collector and is associated with an anodic current collector which may be of the rigid type. That is, the membrane electrode on the anode side is engaged by a foraminous current distributor which is supported more or less rigidly.

Of course the anode collector may be welded to the ribs or other supports of the anode end-plate.

In cells for the electrolysis of sodium chlorine brines, the cathode collector more desirably consists of a nickel or nickel-alloy wire or stainless steel, due to the high resistance of these materials to caustic and hydrogen embrittlement.

Any other metal capable of retaining its resilience during use including titanium optionally coated with non-passivating coating such as for example a platinum group metal or oxide thereof may be used.

The latter is particularly useful when used in contact with acidic anolytes.

The resiliently compressible mat of the invention may advantageously perform also the function of electrode. For example a membrane or diaphragm carrying a single electrode layer bonded, embedded or otherwise incorporated on one side thereof, may be disposed between a foraminous current collector, substantially rigid, engaging the electrode layer bonded on the side of the membrane facing the rigid collector, and the resiliently compressible mat, with or without the interposition of a fine mesh thin and pliable foraminous sheet between the compressible mat and the bare face of the membrane.

When used in this mode the resiliently compressed mat, further to insure a good contact between the electrode layer bonded to the membrane and the co-operating foraminous rigid current collector, acts as the counter electrode of the cell.

The compressed mat can provide an active electrodic surface which may be from 2 to 4 times or more the projected surface therefore reducing electrode polarization and the cell voltage at high current densities.

The diameter of the wire utilized may vary within a wide range, depending on the type of forming or texturing being low enough in any event to obtain the desired characteristics of resiliency and deformation at the cell-assembly pressure.

An assembly pressure corresponding to a load between 80 and 500 g/cm$^2$ of electrodic surface is normally required to obtain a good electrical contact between the membrane-bonded electrodes and the respective current-carrying structures or collectors although higher pressures may be used.

It has been found that by providing a deformation of the resilient current collector of the invention of about 1.5–3 millimeters (mm.), which corresponds to a compression not greater than 60% of the thickness of the non-compressed article, at a pressure of about 400 g/m$^2$ of projected surface, a contact pressure with the electrodes may be obtained in the above cited limits also in cells with a high surface development and with deviations from planarity up to 2 millimeters per meters (mm/m).

The metal wire diameter is preferably comprised between 0.1 and 0.7 mm, while the thickness of the non-compressed article, that is, either the coils' diameter or the amplitude of the crimping is preferably in the range of 4 and 20 mm. Thus it will be apparent that the article encloses a large free volume i.e. the proportion of occupied volume which is free and open to electrolyte flow and gas flow.

In the wrinkled (which includes these compressing wire helixes) fabrics described above this percent of free volume is above 75% of total volume occupied by the fabric. This percent of free volume rarely should be less than 25% and preferably should not be less than 50%. Pressure drop in the flow of gas and electrolyte through such a fabric is negligible.

To better illustrate the various characteristics of the invention, the following drawings are enclosed, illustrating practical embodiments of the invention, whereof:

FIGS. 1, 2 and 3 show some preferred types of the resilient current collector suitable for practice of the invention.

Figure 1:
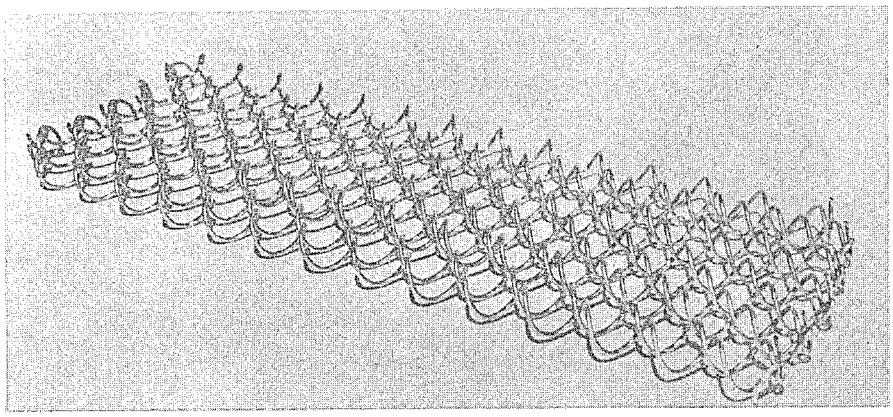
FIG. 1 is a photographic reproduction of an embodiment of a typical resiliently compressible mat used in the practice of this invention.

The current collector of FIG. 1 is comprised of a series of interlaced helicoidal cylindrical spirals 1, consisting of a 0.6 mm. diameter nickel wire, their coils being mutually wound one inside the adjacent one respectively and having a coil's diameter of 15 mm.

Figure 2:
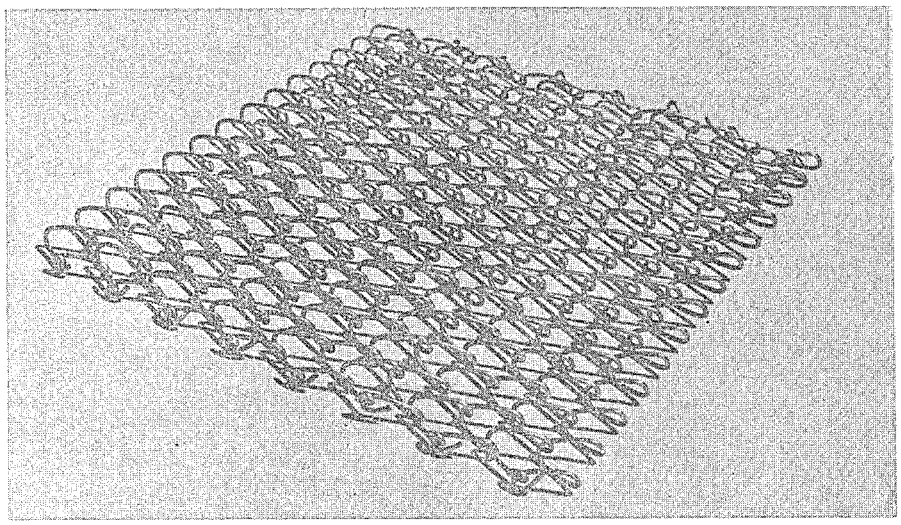
FIG. 2 is a photographic reproduction of another embodiment of the resiliently compressible mat which may be used according to this invention.

A typical embodiment of the structure of FIG. 2 substantially comprises helicoidal spirals 2, having a flattened or elliptical section made with 0.5 mm-diameter nickel wire, their coils being mutually wound one inside the adjacent one respectively the minor axis of the helix being 8 mm.

Figure 3:
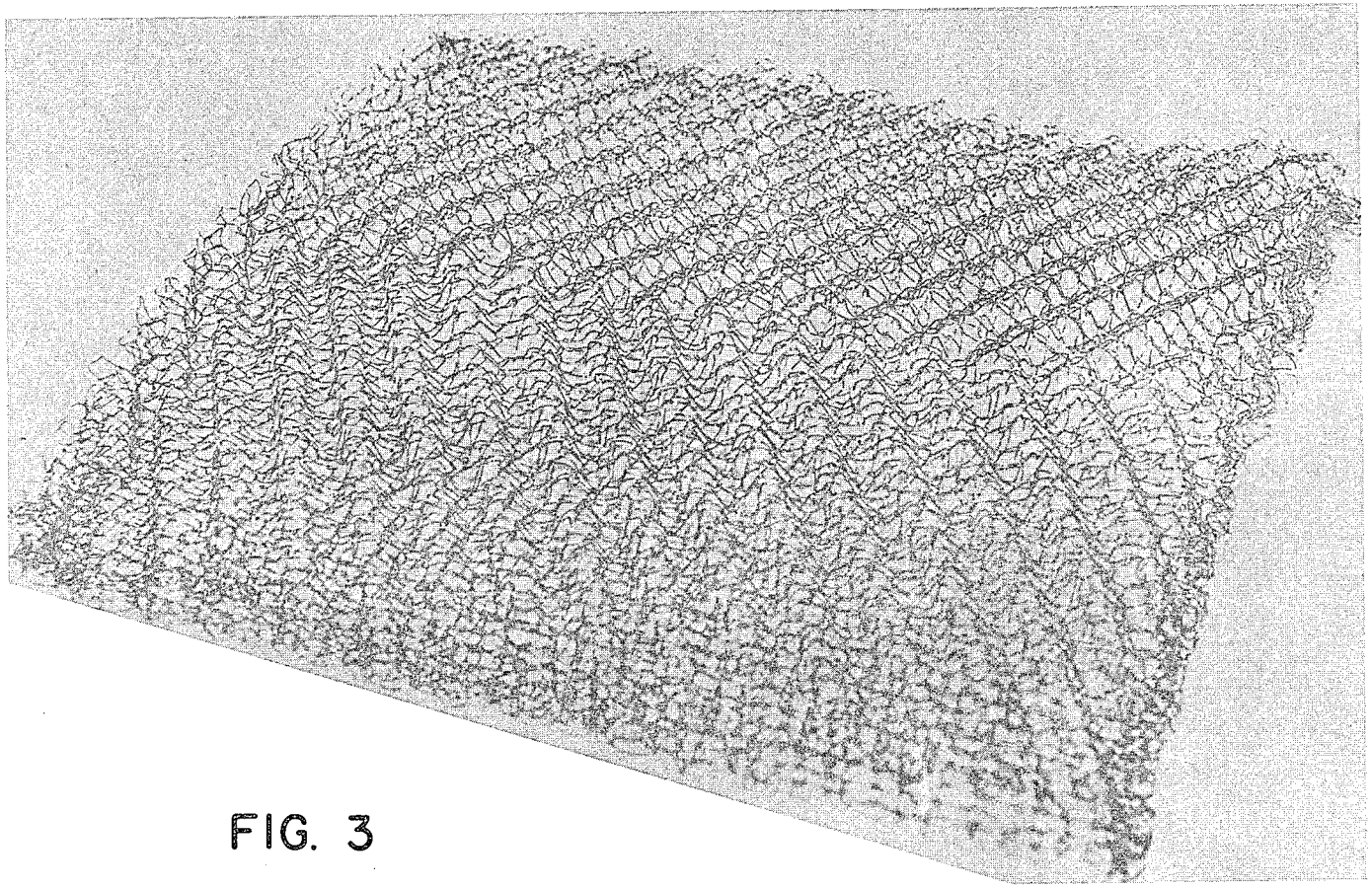
FIG. 3 is a photographic reproduction of a further embodiment of the resiliently compressible mat used according to this invention.

A typical embodiment of the structure of FIG. 3 consists of a 0.15 mm-diameter nickel wire knitted mesh, crimped by forming. The amplitude or height or depth of the crimping is 5 mm, with a pitch between the waves of 5 mm.

Figure 4:
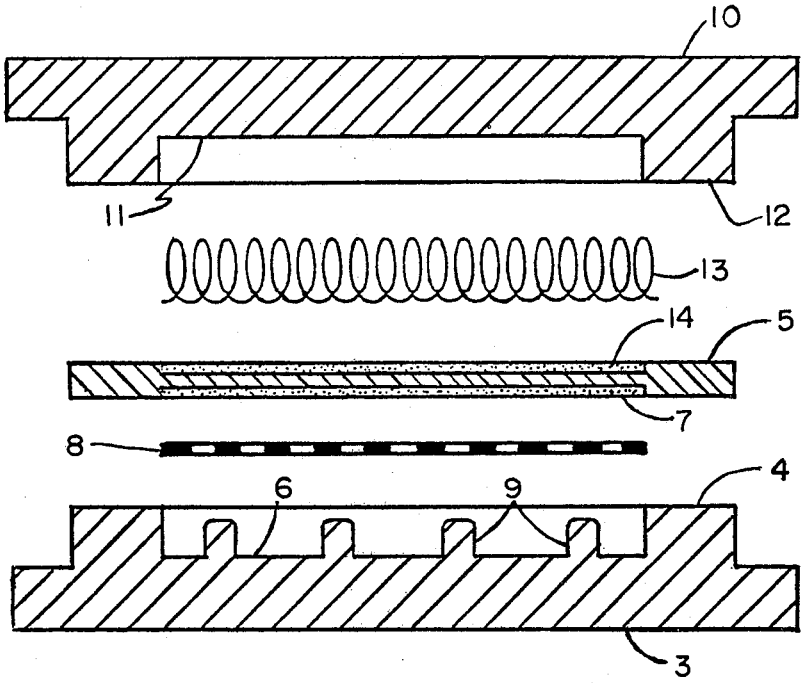
FIG. 4 is an exploded sectional view of a solid electrolyte cell constructed according to this invention and having installed therein one type of the current collector herein contemplated.

Referring to FIG. 4, the solid electrolyte cell, particularly useful in the sodium chlorine brine electrolysis and embodying one of the contemplated current collectors of the invention, is essentially comprised of a vertical anodic end-plate 3 provided with a seal surface 4 along the whole perimeter thereof to sealably contact the peripheral edges of the membrane 5 with the insertion, if desired, of a liquid impermeable insulating gasket, not illustrated; the anodic end-plate 3 is also provided with a central recessed area 6 with respect to said seal surface, with a surface corresponding to the area of anode 7 bonded to the membrane surface.

The end-plate may be made of steel with its side contacting the anolyte cladded with titanium or another passivatable valve metal or it may be of graphite or mouldable mixtures of graphite and a chemically resistant resin binder.

The anodic collector preferably consists of a titanium, niobium or other valve metal screen or expanded sheet 8, coated with a non-passivatable and electrolysis-resistant materials such as noble metals and/or oxides and mixed oxides of platinum group metals.

The screen or expanded sheet 8 is welded or more simply rests, on the series of ribs or projections 9 of titainium or other valve metal, welded on the central recessed zone 6 of the cell end-plate, so that the screen plane is parallel and preferably coplanar with the plane of the seal surface 4 of the end-plate. The vertical cathodic end-plate 10 presents on its inner side a central recessed zone 11 with respect to the peripheral seal surfaces 12.

Said recessed zone 11 is substantially planar, that is ribless, and parallel to the seal surfaces plane. Inside said recessed zone of the cathodic end-plate there is positioned the resilient compressible current collector of the invention 13, preferably of nickel-alloy.

The thickness of the non-compressed resilient collector is preferably from 10% to 60% greater than the depth of the recessed central zone 11, with respect to the plane of the seal surfaces. During the assembly of the cell, the collector is compressed from 10% to 60% of its original thickness, therefore exerting an elastic reaction force preferably in the range of 80–600 g/cm$^2$ of projected surface.

The cathodic end plate 10 may be made of steel or any other conductive material resistant to caustic and hydrogen.

The membrane 5 is preferably an ion-exchange membrane, fluid-impervious and cation-permselective, such as for example a membrane consisting of a 0.3 mm-thick polymeric film of a copolymer of tetrafluoroethylene and perfluorosulfonylethoxyvinylether having ion exchange groups such as sulfonic, carboxylic or sulfonamide groups.

Such membranes are produced by E. I. Du Pont de Nemours under the trademark of Nafion.

The anodic side of the membrane bears, bonded thereto, the anode 7 comprising a 20–150 μm-thick porous layer of particles of conductive and electrocatalytic material, preferably consisting of oxides and mixed oxides of at least one of the platinum group metals.

The cathodic side of the membrane bears, bonded thereto, the cathode 14, comprised of a 20–150 μm thick porous layer of particles of a conductive material with a low hydrogen-overvoltage preferably consisting of graphite and platinum-black in a weight ratio from 1:1 to 5:1.

The binder utilized to bond the particles to the membrane surface is preferably polytetrafluoroethylene and the electrodes are formed by sintering a mixture of PTFE and conductive catalytic material particles forming the mixture into a porous film and pressing the film onto the membrane at high enough temperature to effect bonding.

The electrodes bonded on the membrane surfaces have a projected area practically corresponding to the central recessed areas 6 and 11 of the two end-plates.

Figure 5:
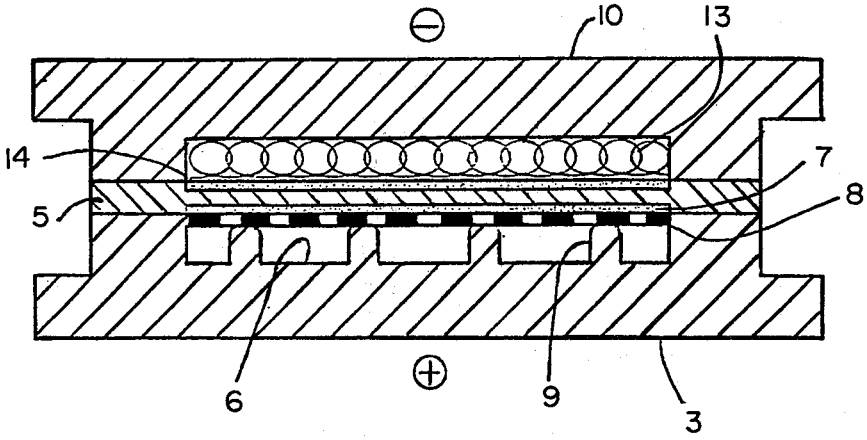
FIG. 5 is a sectional view of the assembled cell of FIG. 4.

FIG. 5 represents the cell of FIG. 4 in the assembled state, wherein the parts corresponding to both drawings are labelled with the same numbers.

As shown in this view the end plates 3 and 10 have been clamped together compressing the helical coil sheet or mat 13 against the electrode 14.

During the cell operation, the anolyte, consisting, for example of a saturated sodium chlorine brine, is circulated through the anode chamber 15, more desirably feeding fresh anolyte through an inlet pipe, not illustrated, in the vicinity of the chamber bottom and discharging the spent anolyte through an outlet pipe, not illustrated, in the proximity of the top of said chamber together with the evolved chlorine.

The cathode chamber 16 is fed with water or diluted caustic through an inlet pipe, not illustrated, at the bottom of the chamber, while the caustic produced is recovered as a concentrated solution through an outlet pipe, not illustrated, in the upper end of said cathode chamber 16.

The hydrogen evolved at the cathode may be recovered from the cathode chamber either together with the concentrated caustic solution or through another outlet pipe at the top of the chamber.

Because the mesh of the resilient collector is open there is little or no resistance to gas or electrolyte flow through the compressed collector.

The anodic and cathodic end-plates are both properly connected to an external current source. The current passes through the series of ribs 9, to the anodic current collector 8, wherefrom it is then distributed to anode 7 through the multiplicity of contact points between the expanded sheet 8 and the anode 7.

The ionic conduction essentially occurs across the ion-exchange membrane 5, the current being substantially carried by the sodium ions migrating across the cationic membrane 5 from the anode 7 to the cathode 14 of the cell. The current collector 13 collects the current from cathode 14 through the multiplicity of contact points between the nickel wire and the cathode, then transmits it to the cathode end-plate 10 through pluralities of contact points.

After the assembling of the cell, the current collector 13, in its compressed state which entails a deformation preferably between 10 and 60% of the original thickness of the article, that is of the single coils or crimps thereof, exerts an elastic reaction force against the cathode 14 surface and therefore against the restraining surface represented by the substantially indeformable anodic current collector 8.

Such reaction force maintains the desired pressure on the contact points between the cathodic collector and the anodic collector with the cathode 14 and the anode 7 respectively.

The absence of mechanical restraints to the differential elastic deformation between adjacent spirals or adjacent crimps of the resilient current collector allows the same to adjust to unavoidable slight deviation from planarity or parallelism between the co-operating planes represented by the anodic collector 8 and the surface 11 of the cathode compartment respectively: such slight deviations normally occurring in standard fabrication processes may therefore be compensated to a substantial degree.

A further advantage resides in the fact that the cathodic end-plate requires no ribs or projections, thus greatly simplifying the machining and grinding operations of the contact surfaces. The advantages of the resilient current collector of the invention are fully realized and appreciated in industrial filter-press-type electrolyzers which comprise a great number of elementary cells clamped together in a series-arrangement to form modules of high production capacity.

In this instance, the end-plates of the intermediate cells are represented by the surfaces of bipolar separators bearing the anode and cathode current collector on each respective surface. The bipolar separators, therefore, besides acting as the defining walls of the respective electrodic chambers, electrically connect the anode of one cell to the cathode of the adjacent cell in the series.

Thanks to their elevated deformability, the resilient current collectors of the invention afford a more uniform distribution of the clamping pressure of the filter-press module on every single cell.

However, in this case, the use is recommended of resilient gaskets on the seal-surfaces of the single cells, to avoid limiting the resiliency of the compressed filter-press module to the membranes resiliency: a greater advantage may thus be taken of the elastic deformation properties of the resilient collectors within each cell of the series.

Various possible modifications of the practical embodiments of the invention may be resorted to by the skilled artisan. For example, a thin metal screen or expanded sheet, flexible enough to have no substantial effect on the deformation of the resilient collector during assembling of the cell, may be inserted between the electrode and the current collector, to increase the number of contact points per surface unit between the latter and the electrode bonded on the membrane surface.

Figure 6:
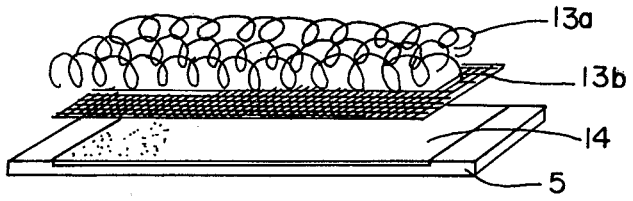
FIG. 6 is an exploded perspective view of another preferred embodiment of the current collector of the cell of FIG. 4.
Figure 7:
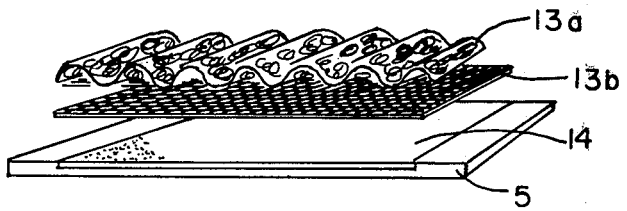
FIG. 7 is an exploded perspective view of another preferred embodiment of the current collector of the cell of FIG. 4.

In FIGS. 6 and 7 there are schematically shown, by exploded perspective partial views, two preferred embodiments of the resilient compressible current collector mat 13 of the cell illustrated in FIGS. 4 and 5. For simplicity's sake only the relevant parts are depicted and they are indicated by the same numerals as in FIGS. 4 and 5. The resiliently compressible mat of FIG. 6 comprises a series of helicoidal cylindrical spirals of 0.6 mm-diameter nickel wire 13*a*, their coils being preferably mutually wound one inside the other as more clearly seen in the photographic reproduction of FIG. 1.

The diameter of the coils is 10 mm. Between the resilient fabric or sheet 13*a* and the membrane 5, carrying on its surface the cathode layer 14, there is disposed a thin foraminous sheet 13*b* which may be advantageously an expanded 0.3 mm-thick nickel sheet. The foraminous sheet 13*b* is readily flexible or pliable and offers negligible resistance to bending and flexing under the elastic reaction force exerted by the wire loops of sheet 13*a* upon compression against the membrane 5.

FIG. 7 depicts a similar embodiment as that described in FIG. 6 but wherein the resiliently compressible fabric or layer 13*a* is a crimped knitted fabric of 0.5 mm-diameter nickel wire such as that illustrated in the photographic reproduction of FIG. 3.

Figure 8:
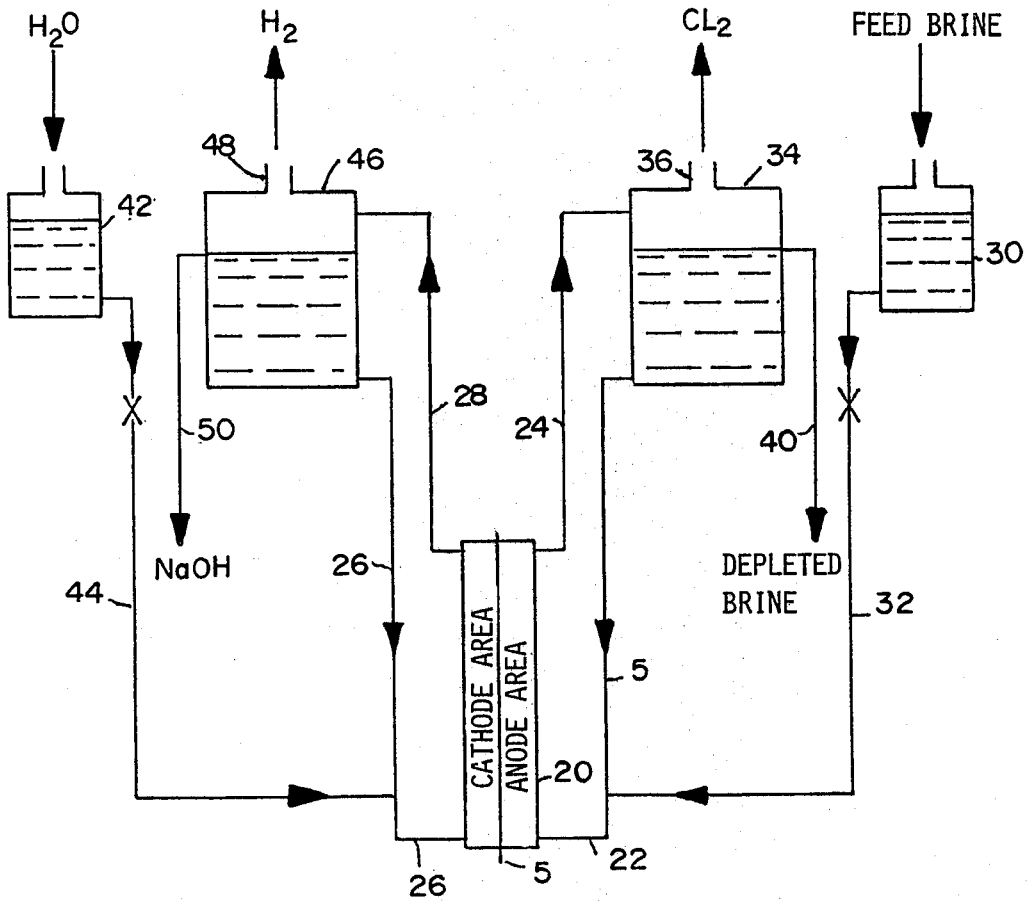
FIG. 8 is a schematic diagram illustrating the electrolyte circulating system used in connection with the cell herein contemplated.

FIG. 8 diagrammatically illustrates the manner of operating the cell herein contemplated. As shown therein a vertical cell 20 of the type illustrated in the cross-sectional view in FIG. 5 is provided with anolyte inlet line 22 which enters the bottom of the anolyte chamber (anode area) of the cell and anolyte exit line 24 which exits from the top of the anode area. Similarly catholyte inlet line 26 discharge into the bottom of the catholyte chamber of cell 20 and the cathode area has an exit line 28 located at the top of the cathode area. The anode area is separated from the cathode area by membrane 5 having anode 7 bonded thereto on the anode side and cathode 14 bonded thereto on the cathode side (See FIG. 4). The membrane-electrode extends in an upward direction. Generally its height ranges from about 0.4 to 1 meter or higher.

The anode chamber of area is bonded by the membrane and anode on one side and the anode end wall 6 (FIG. 5) on the other while the cathode area is bonded by the membrane and the cathode on one side and the upright cathode end wall on the other. In the operation of the system the aqueous brine is fed from a feed tank 30 into line 22 through a valved line 32 which runs from tank 30 to line 5. Also a recirculation tank 34 is provided and discharges brine from a lower part thereof through line 5. The brine concentration of the solution entering the bottom of the anode area is controlled to be at least close to saturation by proportioning the relative flows through line 32. The brine entering the bottom of the anode area flow upward and in contact with the anode. Consequently chlorine is evolved and rises with the anolyte and both are discharged through line 24 tank 34. Then chlorine is separated and escapes as indicated through exit port 36. The brine is collected in tank 34 and is recycled. Some portion of this brine is withdrawn as depleted brine through overflow line 40 and sent to a source of solid alkali metal halide for resaturation and purification. Alkaline earth metal in the form of halide or other compound is held low well below one part per million parts of alkali metal halide and frequently as low as 50 to 100 parts of alkaline earth metal per billion parts by weight of alkali halide. On the cathode side water is fed to line 26 from a tank or other source 42 through line 44 which discharges into recirculating line 26. Here it is mixed with recirculating alkali metal hydroxide (NaOH) coming through line 26 from recirculation tank. The water alkali metal hydroxide mixture enter the bottom of the cathode area and rises toward the top thereof through the compressed gas permeable mat 13 (FIG. 5) or current collector. During this use it contacts cathode 7 and hydrogen gas as well as alkali metal hydroxide are formed. The cathode liquor discharges through line 28 into tank 46 where hydrogen is separated through port 48. Alkali metal hydroxide solution is withdrawn through line 50. Water fed through line 44 is controlled to hold the concentration of NaOH or other alkali at the desired level.

This concentration may be as low as 5 or 10% alkali metal hydroxide by weight. Normally this concentration is above about 15% preferably in the range of 20 to 40 percent by weight. Since gas is evolved at both electrodes it is possible and in deed advantageous to take advantage of the gas lift properties of evolved gases. This is accomplished by running the cell in a flooded condition and holding the anode and cathode chambers relatively narrow for example 2 to 8 centimeter in width. Under such circumstances evolved gas rapidly rises carrying electrolyte therewith and slugs of electrolyte and gas are discharged through the discharge pipes into the recirculating tanks. This circulation may be supplemented by pumps if desired. Knitted metal fabric which is suitable for use as the current collector of the invention is manufactured by Knitmesh Limited a British Company having an office at South Croydon, Surrey. The knitted fabric may vary in size and degree of fineness. Wire used conveniently ranges from 0.1 to 0.7 millimeters althrough larger or smaller wires may be resorted to.

These wires are knitted to provide about 2.5 to 20 stitches per inch preferable in the range of about 8 to 20 stitches or openings per inch. Of course it will be understood that wide variations are possible. Thus undulating wire screen having a fineness ranging from 5 to 100 mesh may be used.

The interwoven, interlaced or knitted metal sheets are crimped to provide a repeating wavelike contour or are loosely woven or otherwise arranged to provide thickness to the fabric which is 5 to 100 or more times the diameter of the wire. Thus the sheet compressible.

However because the structure is interlaced and movement is restricted by the structure, elasticity of the fabric is preserved.

This particularly true when it is crimped or corrugated in an orderly arrangement of spaced waves such as in a herringbone pattern. Several layers of this knitted fabric may be superimposed if desired.

Where helix construction illustrated in FIG. 3 is resorted to the wire helices should be elastically compressible. The diameter of the wire and the diameter of the helices are such as to provide the necessary compressibility and resiliency.

The diameter of the helix is generally 10 or more times the diameter of the wire in its uncompressed condition. For example 0.6 mm-diameter nickel wire wound in helices of about 10 mm-diameter has been used satisfactorily.

Nickel wire is suitable when the wire is cathodic as has been desribed above and illustrated in the drawings.

However any other metal capable or resisting cathodic attack or corrosion by the electrolyte or hydrogen embrittlement may be used.

These may include stainless steel, copper, silver coated copper or the like.

While in the embodiments described above the compressible collector is shown as cathodic it is to be understood that the polarity of the cells may be reserved so that the compressible collector is anodic.

Of course in that event the collector wire must resist chlorine and anodic attack. Accordingly the wires may be of a valve metal such as titanium or niobium and preferably coated with an electroconductive non passivating layer resistant to anodic attack such as platinum group metal or oxide, bimetallic spinel perovskite etc.

Application of the compressible member to the anode side may in some cases create a problem because halide electrolyte flow may be restricted.

When the anode does not have sufficient access to anolyte flowing through the cell, the halide concentration may become reduced in local areas due to electrolysis and, when it is reduced to too great extent, oxygen rather than halogen tends to be evolved as a result of water electrolysis.

Thus care must be taken to prevent the pressure mat from restricting continuous flow of halide electrolyte in contact with anode surface.

This is accomplished by maintaining the points of electrode contact small i.e. less than one millimeter in width. It can also be effectively accomplished by maintaining a screen of relatively fine mesh 50 mesh or greater between the compressible mat and the electrode surface.

Although these problems are also important on the cathodes less difficulty is encountered since the cathodic reaction is to evolve hydrogen and there is no occurence of side reaction; the products are generated even though the points of contact are relatively large because water and the alkali metal ion migrate through the membrane thus even if the cathode presents some restriction an amount of biproduct formation is less likely to occur.

Therefore it is advantageous to apply the compressible mat to the cathode side. The compressible collector or distributor may bear directly against the electrode bonded to the membrane or diaphragm. It may be advantageous to interpose a thin foraminous flexible sheet such as fine mesh stainless steel or nickel screen or stainless steel or graphite paper between the electrode and the compressible collector.

This screen is less compressible than the collector and indeed may be substantially uncompressible. It serves to protect the electrode from the collector. Also it provides a greater total contact area than would be provided by the collector which is more open in its construction.

Generally it has a mesh or opening size smaller than the openings of the compressible mat.

Again the resiliently compressible metal wire fabric, with or without the interposition of a pliable thin foraminous screen, may also effectively act as the electrode. Therefore the membrane may carry one single electrode layer (for example an anode layer) or none and the assembled cell may comprise a rigid foraminous anode current collector or anode of titantium coated with a non-passivatable coating, the membrane or diaphragm, and the resilient mat, of nickel wire or other suitable cathodic material having low hydrogen overpotential, compressing the membrane against the rigid foraminous anode current collector or anode.

The cell herein contemplated may be used to generate chlorine by electrolysis of aqueous sodium chloride solution containing 150 grams or more of NaCl. Usually a saturated or substantially saturated solution is used.

Thus a saturated solution of sodium chloride is fed into the bottom of the anolyte chamber of the cell illustrated in FIG. 5.

This solution is fed rapidly enough so that the sodium chloride solution exiting from the top of the cell rarely falls more than 20 to 25 grams per liter from the initial entering concentration. However the depletion may be as high as 100 gr/liter.

Water or dilute caustic is fed into the bottom of the cathode chamber and hydrogen and aqueous caustic soda is withdrawn from the top.

The caustic soda solution may be recycled if desired. Rate of water feed and caustic recycle is controlled to produce sodium hydroxide solution containing at least 12 percent and preferably at least 18% NaOH.

Solutions containing 30 to 40% NaOH can be produced if desired. Sodium carbonate can be produced by feeding alkali bicarbonate or carbon dioxide into the catholyte chamber.

Current densities generally are at least 1000 preferably 2000–5000 amperes per square or higher.

Other halides including hydrochloric and, potassium or lithium chloride or the corresponding bromides or iodides may be electolyzed in a similar manner.

It will also be understood that this cell may be used for other purposes such as the electrolysis of water to produce hydrogen and oxygen.

The cells herein described above resort to a compressible current collector or electrode fabric associated with but a single electrode of the cell i.e. the cathode or the anode.

Both electrodes may be provided with such a collector if desired or be constituted by the same. For example the ribs 9 illustrated in FIGS. 4 and 5 may be dispensed with to provide an electrolyte chamber similar to that of the opposed back plate 10.

In that case a compressible collector may be inserted so that both anode and cathode chambers are similary constructed with compressible current collectors or distribution on both sides of the membrane.

The membranes are flexible ion exchange polymers capable of transporting ions. Normally, they have boiled in an aqueous electrolyte such as acid or alkali metal hydroxide and thereby become highly hydrated thus containing a considerable amount 10–15% or more by weight of water either combined as hydrate or simply absorbed.

The electrodes conveniently may be particulate electroconductive materials which have a low chlorine and/or hydrogen over-voltage.

Platinum group metals or oxides in pulverulent form are suitable. These may be mixed with graphite, valve metal oxides or other materials which extend and/or facilitate their operation. On the cathode side the particles may comprise nickel or iron which may be coated with a catalyst such as platinum group metal silver etc.

Generally the particles are porous and have a surface area above about 25 for example 100 to 200 square meters per gram measured by nitrogen absorption.

As described above the gas permeable electrodes are formed by mixing with tetrafluoroethylene polymer or like resistant fluorocarbon polymer usually in the proportion of 1–20 parts by volume of particles per volume of polymer and the mixture is formed into a porous sheet. This sheet is then bonded to one or both sides of the membrane.

This bonding is effected by assembling a sandwich of the electrodic sheets with the membrane between and pressing the assembly together to embed electrode particles in the membrane.

Usually the membrane has been hydrated as described before this lamination process.

In that case care must be exerted to prevent excessive loss of water during the lamination process.

Since this lamination is achieved by applying heat as well as pressure to the laminate water may tend to evaporate.

This may be held to a minimum by one or more of the following:

1. enclosing the laminate in an impermeable envelope i.e. between metal foils pressed or sealed at their edges to hold a water saturated atmosphere about the laminate
2. proper design of the mold to quickly return water in the laminate
3. molding in a steam atmosphere.

According to a further embodiment the flexible screen bearing against the electrode may be pressed against the screen by a nonconductive flexible compressible resilient backing which is coextensive with the screen and comprises knitted compressible crimped fabric or otherwise to transmit pressure from the back plate towards the electrode and laterally.

These knitted or helical structures may be constructed in the same manner as described above. They may be composed of polypropylene cords or strands which have sufficient stiffness to impart resilience to the structure.

In such an embodiment some means must be provided to impart polarity to the conductive screen bearing against the electrode layer. For example electrical wires may extend from the backwall of the cell to and be welded to the conductive screen. Alternatively insulated electrical connectors may extend through the floor or roof of the cell and be welded to the screen.

Normally the diaphragm is not only permeable to ion transfer, being essentially a solid electrolyte, but also substantially imperforate or impervious to flow of electrolyte from one electrode chamber to the opposed electrode chamber.

However perforate diaphragms which permit such flow may be resorted to in some cases.

Under these circumstances sufficient flow through the diaphragm is required to prevent the catholyte products into the anode chamber or vice versa.

This may be difficult where the electrodes are so close together.

Consequently the diaphragm generally does not permit electrolyte flow to any appreciable extent.

Although the present invention has bees described with particular reference to details of certain embodiments thereof it is not intended that such details shall limit the scope of the invention except included in the accompanying claims.

What is claimed:

1. An electrolytic cell which comprises a flexible ion permeable diaphragm having at least one complaint electrode layer bonded to or otherwise incorporated on one side thereof, a current distributor bearing against the layer, said distributor having an electroconductive surface adapted to impart polarity to the layer, and a cooperating counter electrode disposed at the other side of the diaphragm, said current distributor or said counter electrode comprising a resiliently compressible mat coextensive with said electrode layer dimensions, said mat being capable of being compressed in the direction of the diaphragm and to exert an elastic reaction force towards the diaphragm at a multiplicity of pressure points and capable to transfer excess resilient force acting on one or more pressure points to other neighbouring pressure points in a lateral direction along a major dimension of the mat whereby compressing pressure can be effectively distributed over the entire surface of the layer, said mat being open to permit flow of electrolyte through it means slideable with respect to the mat to compress the mat toward the diaphragm and a rigid support on the other side of the flexible diaphragm to restrain diaphragm displacement.

2. The cell of claim 1 wherein the diaphragm is supported in an upright alignment.

3. The cell of claim 1 wherein the resiliently compressible mat comprises a pliable electroconductive screen on the surface of the mat facing towards the diaphragm and a separate compressible fabric slideable with respect to the screen said fabric being resiliently compressible, the screen being less compressible than the fabric.

4. The cell of claim 3 wherein the open volume of the compressible fabric is not less than 25 percent of the volume occupied by the fabric.

5. The cell of claim 1 wherein the mat is electroconductive metal.

6. The cell of claim 1 wherein the mat is wrinkled metal mesh.

7. The cell of claim 6 wherein the compressing means compresses the mat to at least one half of its volume.

8. The cell of claim 1 wherein the mat is metal mesh crimped in the form of pluralities of adjacent waves.

9. The cell of claim 1 wherein the diaphragm is a flexible ion exchange, fluorocarbon polymer.

10. The cell of claim 9 wherein the compressing means is capable of applying a pressure of at least 80 grams per centimeter against the diaphragm sheet.

11. An electrolytic cell which comprises an enclosure having a flexible ion permeable diaphragm sheet aligned in an upright direction; said diaphragm sheet having electroconductive electrode layers compliant thereto bonded to the sheet on opposite sides thereof with a substantially rigidly mounted foraminous electroconductive current distributor bearing against one of said layers and a resiliently compressible current distributor bearing against the other layer; said current distributor being compressed against the layer against which it bears and also capable of transmitting excess compressive force from one area, in a lateral direction, toward adjacent lower pressure areas and means slideable with respect to said distributor to compress the distributor against the layer.

12. The cell of claim 11 wherein the mat comprises wrinkled metal mesh.

13. The cell of claim 11 wherein the mat comprises metal mesh crimped in the form of pluralities of adjacent waves.

14. The cell of claim 11 wherein the mat comprises knitted metal wires.

15. The cell of claim 11 wherein the compressible current distributor is connected to the negative pole of an electrolizing potential source.

16. The cell of claim 11 wherein the distributor comprises a plurality of compressible adjacent metal wire helices.

17. The cell of claim 16 wherein the helices are interwined.

18. The cell of claim 11 wherein the compressible mat has curved springy elements which extend across the thickness of the sheet and which are compressible and impart resilience to the sheet.

19. An electrolyte cell which comprises a flexible ion permeable membrane having opposed gas and liquid permeable electrodes in contact with opposite sides thereof and means to impart polarity to at least one of said electrodes comprising a resilient mat comprising a resiliently compressible undulating metal wire mat open to gas and electrolyte flow, means slideable with respect to the mat to compress said mat against the electrode and a rigid support on the opposite side of the flexible diaphragm to restrain diaphragm displacement.

20. The cell of claim 19 wherein the mat engages the cell cathode.

21. The cell of claim 19 wherein the mat comprises helically wound wire.

22. The cell of claim 19 wherein the mat comprises undulating knitted wire mesh.

23. The cell of claim 19 wherein the membrane is a flexible ion exchange fluorocarbon polymer.

24. The cell of claim 19 wherein the compressing means compresses the mat to at least one half its volume.

25. The cell of claim 24 wherein the mat is sufficiently open to have an open volume of not less than 25 percent of the mat volume and wherein the mat and the electrodes are vertical.

26. The cell of claim 19 wherein the electroconductive, electrode screen is disposed between the mat and the membrane.

27. The cell of claim 26 wherein the screen has a finer mesh than the network of the mat.

28. The cell of claim 19 wherein the membrane is flexible and means more rigid than the mat are provided on the side of the membrane opposite to said mat to support the membrane.

29. The cell of claim 19 wherein mat surfaces are moveable with respect to pressure surfaces.

30. The cell of claim 19 wherein the mat has a void space of at least 50% of its volume.

31. An electrolytic cell comprising a vertical flexible ion permeable diaphragm having opposed electrodes on opposite sides thereof, at least one of said electrodes comprising a compressible resilient, electrolyte-permeable mat open to gas and electrolyte flow and having a conductive polarized electrode surface associated therewith in contact with the diaphragm and means slideable with respect to the mat for compressing the mat against the diaphragm and more rigid means on the opposite side of the diaphragm to support the diaphragm.

32. The cell of claim 31 wherein the polarized surface comprises a conductive screen slideable with respect to the mat between the mat and the diaphragm.

33. The cell of claim 32 wherein the conductive screen is of finer mesh size than the mat.

34. The cell of claim 31 wherein the diaphragm is a cation exchange polymer, the mat is cathodically polarized and a screen of finer mesh than the mat is interposed between the mat and the diaphragm.

35. The cell of claim 31 wherein the mat is compressible to at least 50 percent of its volume while retaining an open volume.

36. The cell of claim 19 or 31 wherein the mat is compressed 10% or more of its uncompressed thickness.

37. The cell of claim 19 or 31 wherein the diaphragm is an upright sheet and the mat is sufficiently open to permit flow of electrolyte and gas along the diaphragm.

38. The cell of claim 19 or 31 wherein the mat is cathodic and the anode extends along the opposite side of the diaphragm.

39. The cell of claim 19 or 31 wherein the mat is cathodic and gas and electrolyte to flow edgewise therethrough.

40. An electrolytic cell which comprises a flexible ion permeable diaphragm having opposed gas and liquid permeable electrodes in contact with opposite sides thereof, at least one of said electrodes comprising a compressible resilient electrolyte permeable mat open to gas and electrolyte flow and having a conductive polarized electroconductive surface associated therewith and in contact with the diaphragm and a less compressible electroconductive screen interposed between the mat and the diaphragm.

41. The cell of claim 40 wherein the screen is of finer mesh than the mat.

42. The cell of claim 40 or 41 wherein the mat is compressible at least 10% of its thickness.

43. The cell of claim 40 or 42 wherein the diaphragm has an electrode layer bonded to the diaphragm and between the screen and the diaphragm.

44. The cell of claim 40 wherein the mat is cathodically polarized and the diaphragm has an opposed electrode on the side remote from the mat and said electrode provides the diaphragm with support more rigid than the mat.

45. An electrolytic cell having an anode and a cathode separated by a flexible ion permeable diaphragm, one of said electrodes comprising a planar backwall and a compressible resilient electroconductive electrolyte permeable mat having an electrodic surface associated therewith and between the backwall and the diaphragm, means to compress the mat and the backwall against the diaphragm and a more rigid support for the diaphragm on the opposite side thereof.

46. The cell of claim 45 wherein the mat is cathodic.

47. The cell of claim 45 or 46 wherein the diaphragm is an upright sheet and the mat extends along the diaphragm and means are provided to flow electrolyte through the mat and along the diaphragm and a less yieldable electrode is in contact, with the diaphragm on the opposite side thereof.

* * * * *